United States Patent [19]

Levin

[11] 4,412,360

[45] Nov. 1, 1983

[54] METHOD OF AND APPARATUS FOR PROVIDING A PERSONAL SANITARY TOILET SEAT COVER

[76] Inventor: Harold Levin, 725 Providence Rd., Charlotte, N.C. 28207

[21] Appl. No.: 273,863

[22] Filed: Jun. 15, 1981

[51] Int. Cl.[3] ..... A47K 13/14

[52] U.S. Cl. ..... 4/242

[58] Field of Search ..... 4/242, 243

[56] References Cited

U.S. PATENT DOCUMENTS

| | | | |
|---|---|---|---|
| 747,960 | 12/1903 | Franken | 4/243 |
| 966,838 | 8/1910 | Jaffee et al. | 4/243 |
| 1,081,091 | 12/1913 | Camelo | 4/243 |
| 1,223,208 | 4/1917 | Sharp | 4/243 |
| 1,491,419 | 4/1924 | Power | 4/242 |
| 1,659,341 | 2/1928 | Wasson | 4/243 |
| 1,733,080 | 10/1929 | Hamilton | 4/242 |
| 2,260,404 | 10/1941 | Richardi | 4/243 |
| 2,302,317 | 11/1942 | Henry | 4/243 |
| 2,312,589 | 3/1943 | Reeves | 4/243 |
| 2,903,713 | 9/1953 | Previte | 4/242 |

FOREIGN PATENT DOCUMENTS

| | | | |
|---|---|---|---|
| 297247 | 9/1928 | United Kingdom | 4/243 |
| 1382092 | 1/1975 | United Kingdom | 4/243 |

*Primary Examiner*—Charles E. Phillips
*Attorney, Agent, or Firm*—Sandler & Greenblum

[57] ABSTRACT

A method of and apparatus for providing a replaceable, personal and sanitary toilet seat are disclosed, wherein a conventional toilet seat forms a base seat onto which is attached various mounting means onto which a protective cover may be detachably mounted. The base seat can only be used, comfortably, with the protective cover because of the protruding mounting means. The protective cover therefore provides a replaceable, personal and sanitary toilet seat cover for a potential user.

10 Claims, 8 Drawing Figures

METHOD OF AND APPARATUS FOR PROVIDING A PERSONAL SANITARY TOILET SEAT COVER

BACKGROUND OF THE INVENTION

1. Field of the Invention

The present invention relates to a method of and apparatus for providing a personal sanitary toilet seat cover.

2. Description of the Prior Art

Several attempts have been made to provide a replaceable and sanitary toilet seat cover which can be placed on a conventional toilet seat by an individual user and later, after use, disposed of by the user.

Exemplary of the prior art is U.S. Pat. No. 2,903,713, which discloses a sanitary replaceable toilet seat cover for a conventional toilet seat. In a modification of this patent, rubber inserts are provided on the protector or shell so as to prevent marring or damaging of the outer surface of the conventional toilet seat.

The prior art is primarily focused on providing a cover for a toilet seat which is optionally usable. However, use of a toilet seat without a protective cover can lead to unsanitary and unhealthy conditions. This is especially true in public rest room facilities wherein a large number of people whose states of health are unknown come into contact with toilet seats.

The object of the present invention is to overcome these inherent limitations by providing a toilet seat that cannot be used without a replaceable and sanitary protective toilet seat cover.

SUMMARY OF THE INVENTION

The present invention comprises a replaceable, personal and sanitary protective cover detachably connected to a conventional toilet seat by specially shaped mounting means attached to the seat. The mounting means forms a surface that potential users of the seat would find uncomfortable without a protective cover. Thus, the presence of the mounting means on the seat forces the user to detachably connect a sanitary protective cover to the mounting means before the seat can be used comfortably. By forcing potential users to use a personal and sanitary protective cover the chance of their contracting disease by contact with a conventional toilet seat is greatly reduced.

The mounting means may be attached permanently to a conventional toilet seat and preferably comprise two pairs of mounts. The first pair of mounts are located to support the thighs and are called front mounts. The second pair of mounts are located to support the buttocks and are called rear mounts. The front mounts may comprise bar shaped pieces attached to the front of the conventional seat. The rear mounts may have a series of different shapes which may provide varying degrees of support for the potential user. The detachable cover is preferably molded of plastic material, for example, by a blow-molding operation. The cover has a top surface conforming to the top surface of a conventional toilet seat and a bottom surface that has means for detachable engagement with the mounting means.

BRIEF DESCRIPTION OF THE DRAWINGS

The features and advantages of the present invention will be more fully appreciated and become better understood from the following detailed description when considered in connection with the annexed drawings in which like reference characters designate like or corresponding parts throughout the several views and wherein.

DETAILED DESCRIPTION

Figure 1:
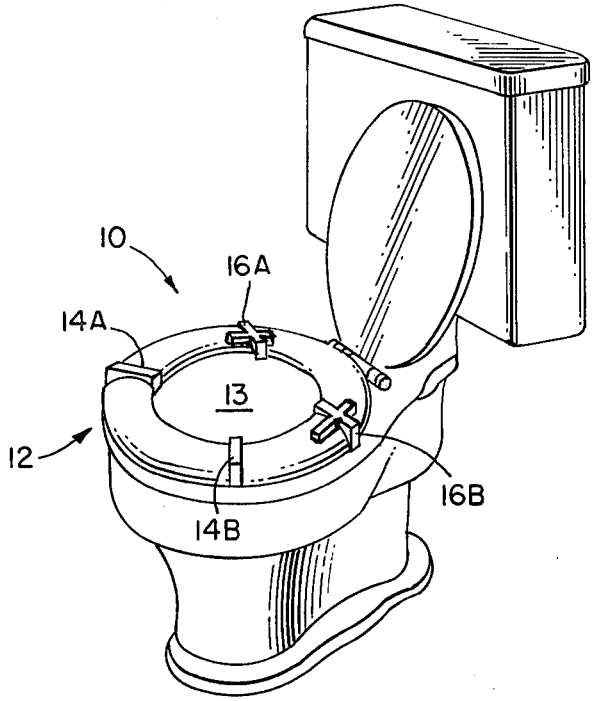
FIG. 1 is a perspective view of a toilet showing a conventional toilet seat to which mounting means according to the present invention are attached.

Referring now to FIG. 1 of the drawings, toilet 10 is shown with a conventional toilet seat having opening 13, the seat hereinafter referred to as base seat 12, on which mounting means 14 according to the invention is attached. The mounting means comprise bar-shaped front mounts **14*a*, 14*b*, and cross-shaped rear mounts 16*a*, 16*b*. Front mounts 14*a* and 14*b* provide support for the thighs of a potential user, whereas rear mounts 16*a* and 16*b* provide support for the buttocks of the potential user. The upper horizontal surfaces of the mounting means lie in substantially the same horizontal plane, so that the mounting means provides a level support. Use of the toilet seat to which mounting means 14** are attached, without any protective cover on the mounting means, would be extremely uncomfortable.

Figure 2:
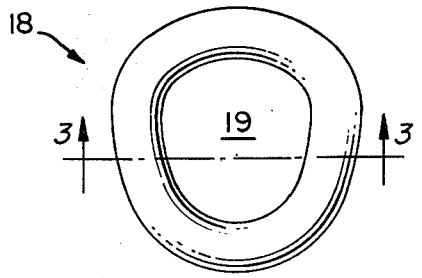
FIG. 2 is a top plan view of the protective cover.
Figure 3:
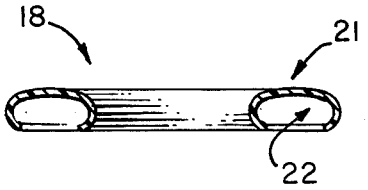
FIG. 3 is a cross-sectional view along line 3—3 of FIG. 2.

Referring now to FIG. 2 of the drawings, replaceable protective cover 18, which is formed of plastic, is shaped into the general configuration of a toilet seat, having opening 19. Preferably, cover 18 is blow-molded to the appropriate configuration.

Figure 4:
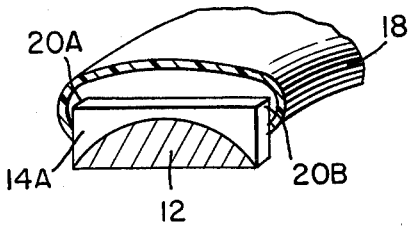
FIG. 4 is a cross-sectional view of the toilet seat with the front mount, onto which is detachably mounted the protective cover.

Protective cover 18 comprises upper surface 21 and lower surface 22; and is adapted to be detachably connected to front mounts **14*a*, 14*b*, and rear mounts 16*a*, 16*b*. As illustrated in FIG. 4, the lower surface 22 makes contact with front corners 20*a* and 20*b* of front mount 14*a*. Corners 20*a*, 20*b* of front mount 14*a* engage inner surface 22 of protective cover 18 and provide lateral stability for the cover. Protective cover 18 thereby establishes a smooth upper surface not unlike a conventional toilet seat, and thus protects the user from the uncomfortable nature of mounting means 14*a*, 14*b*, 16*a*, and 16*b***.

Figure 5:
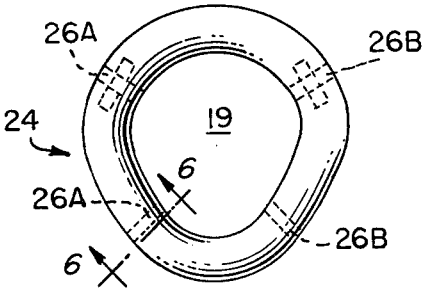
FIG. 5 is a top plan view of a modified form of the protective cover.
Figure 6:
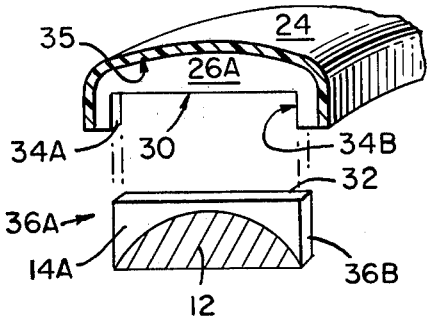
FIG. 6 is a cross-sectional view along line 6—6 of the toilet seat with the front mount to which is detachably mounted the modified protective cover.

FIG. 5 of the drawings is a top view of another embodiment 24 of a protective cover according to the present invention. Seating means in the form of front seats **26*a* and 26*b* and rear seats 28*a* and 28*b* are attached to inner surface 25 of protective cover 24, and are illustrated by broken lines. As can be seen in FIG. 6, front seat 26*a* has an upper engaging surface 30 and two side engaging surfaces 34*a* and 34*b*. When connecting protective cover 24 on front mount 14*a* of base seat 12, upper engaging surface 30 seats on front mount upper surface 32; and side engaging surfaces 34*a* and 34*b* seat with front mount side surfaces 36*a* and 36*b*, respectively. Cover 24 with the above-described seating means provides greater lateral stability when protective cover 24 is in use, and therefore more comfortable seating for the potential user. Front seats 26***a* and 26*b* and rear seats 28*a* and 28*b* can be affixed to the protective cover 24 after it is formed or they may be internally formed during the molding of protective cover 24. Other methods and means for seating protective cover 24 on front mounts 14*a* and 14*b* and rear mounts 16*a* and 16*b* are also contemplated in this arrangement.

Figure 7:
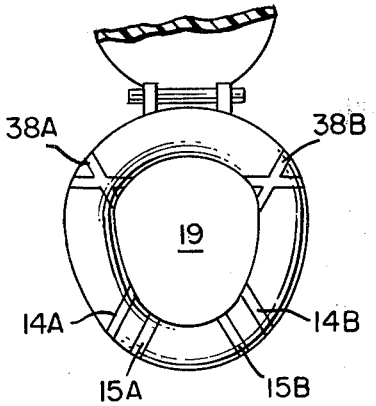
FIG. 7 is a top plan view of a conventional toilet seat with modified mounting means.
Figure 8:
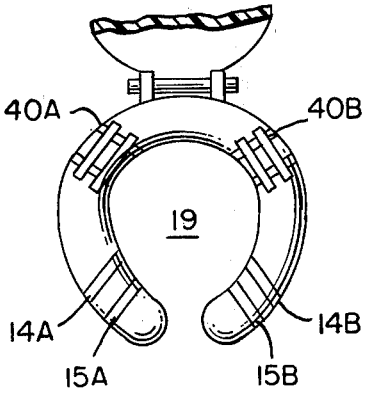
FIG. 8 is a top plan view of a conventional toilet seat with another embodiment of mounting means.

FIGS. 7 and 8 illustrate alternate embodiments of the mounting means. Bar-shaped front mounts 15*a* and 15*b* can be added to front mounts 14*a* and 14*b* to provide more support, as illustrated in FIGS. 7 and 8. The rear mounts can be modified into the form of X-shaped rear mounts 38*a* and 38*b* or hatch-mark shaped rear mounts 40*a* and 40*b*.

In utilizing the above invention, a user selects a replaceable protective cover or shell from a wall-mounted receptacle (not illustrated) and detachably mounts the cover on the mounting means attached to base seat 12 so that openings 13 and 19 are aligned with one another. After the user has accomplished his task, the seat can be disposed of, or disinfected and reused.

From the foregoing description, one skilled in the art can easily ascertain the central characteristics of this invention and without departing from the spirit and scope thereof, can make various changes and modifications of the invention to adapt it to various usages and conditions.

What is claimed is:

1. A toilet seat comprising:

(a) a base seat having an upper surface and an opening;

(b) mounting means attached to, and extending upwardly from, said base seat upper surface, said mounting means comprising at least two mounts, each of said mounts having its uppermost surface, substantially horizontal, said horizontal surfaces being located above the upper surface of said base seat, said upper horizontal surfaces lying in substantially the same plane above the plane of said base seat; and (c) a protective cover adapted to be detachably mounted on said mounting means, said protective cover having a smooth upper surface and an opening corresponding to said base seat opening and means to cooperate with said mounts, whereby when said protective cover is mounted on said mounting means, the mounting means are covered by said cove and are not exposed to a user of said toilet seat.

2. A toilet seat as defined by claim 1 wherein said base seat comprises a conventional toilet seat.

3. A toilet seat as defined by claim 2 wherein said protective cover is made out of plastic.

4. A toilet seat as defined by claim 3 wherein said protective cover has seating means for seating said protective cover to said mounting means.

5. A toilet seat as defined by claim 3 wherein said mounting means comprises at least one pair of front mounts and at least one pair of rear mounts.

6. A toilet seat as defined by claim 5 wherein said at least one pair of front mounts and said at least one pair of rear mounts have upper horizontal surfaces lying in substantially the same horizontal plane, said same horizontal plane being located above the plane of said base seat.

7. A toilet seat as defined by claim 6 wherein each of said at least one pair of front mounts are bar-shaped.

8. A toilet seat as defined by claim 7 wherein each of said at least one pair of rear mounts are cross-shaped.

9. A toilet seat as defined by claim 7 wherein each of said at least one pair of rear mounts are X-shaped.

10. A toilet seat as defined by claim 7 wherein each of said at least one pair of rear mounts are hatch-mark shaped.

* * * * *

UNITED STATES PATENT AND TRADEMARK OFFICE

CERTIFICATE OF CORRECTION

PATENT NO. : 4,412,360

DATED : November 1, 1983

INVENTOR(S) : Harold LEVIN

It is certified that error appears in the above-identified patent and that said Letters Patent is hereby corrected as shown below:

Column 3, line 37, after "surface" delete the ",".

Column 4, line 11, the word "cove" should read ---cover---.

Signed and Sealed this

*Tenth* Day of *January 1984*

[SEAL]

*Attest:*

GERALD J. MOSSINGHOFF

*Attesting Officer*

*Commissioner of Patents and Trademarks*